US007711134B2

(12) United States Patent
Stead et al.

(10) Patent No.: US 7,711,134 B2
(45) Date of Patent: May 4, 2010

(54) SPEAKER PORT SYSTEM FOR REDUCING BOUNDARY LAYER SEPARATION

(75) Inventors: Brendon Stead, Thousand Oaks, CA (US); Clayton Williamson, Moorpark, CA (US)

(73) Assignee: Harman International Industries, Incorporated, Northridge, CA (US)

( * ) Notice: Subject to any disclaimer, the term of this patent is extended or adjusted under 35 U.S.C. 154(b) by 910 days.

(21) Appl. No.: 10/178,400

(22) Filed: Jun. 24, 2002

(65) Prior Publication Data

US 2003/0076975 A1 Apr. 24, 2003

Related U.S. Application Data

(60) Provisional application No. 60/300,640, filed on Jun. 25, 2001.

(51) Int. Cl.
*H04R 25/00* (2006.01)

(52) U.S. Cl. ..... 381/345; 381/349

(58) Field of Classification Search ..... 381/345, 381/346, 349, 353, 354, 162, 165, 338, 337; 181/155, 156, 160, 196, 197, 199
See application file for complete search history.

(56) References Cited

U.S. PATENT DOCUMENTS 4,987,601 A * 1/1991 Goto ..... 181/156
5,623,132 A 4/1997 Gahm ..... 181/156
5,714,721 A 2/1998 Gawronski et al. ..... 181/156
5,892,183 A 4/1999 Roozen et al. ..... 181/156
6,208,743 B1 * 3/2001 Marten et al. ..... 381/415

FOREIGN PATENT DOCUMENTS

JP 2001-501426 (T) 1/2001
JP 2005-122785 (A) 5/2005
JP 2005-176384 (A) 6/2005

OTHER PUBLICATIONS

Alex Salvatti, et al., "Maximizing Performance from Loudspeaker Ports", J. Audio Eng. Soc., vol. 50, No. 1/2, Jan./Feb. 2002, pp. 19-45.
Roozen et al., N.B., "Reduction of Bass-Reflex Port Nonlinearities by Optimizing the Port Geometry", Philips Research Laboratories, (XP008084472), May 1, 1998, pp. 1-24.
Supplementary European Search Report for Application No. 02 73 7586 dated Jan. 16, 2009 (3 pages).

* cited by examiner

*Primary Examiner*—Huyen D Le

(57) ABSTRACT

This invention provides a speaker port with a flare having an inner wall that minimizes or reduces boundary layer separation. Fluids, such as air and sound waves, flow through the port at a higher velocity when boundary layer separation is minimized or reduced. The inner wall of the port is contoured so that the pressure gradient or change in pressure along the longitudinal axis of the port from its inlet duct to outlet duct is substantially constant.

62 Claims, 4 Drawing Sheets

SPEAKER PORT SYSTEM FOR REDUCING BOUNDARY LAYER SEPARATION

RELATED APPLICATIONS

This application is based on U.S. Provisional Patent Application No. 60/300,640 entitled "Flare Design for Minimizing Boundary Layer Separation" and filed on Jun. 25, 2001. The benefit of the filing date of the Provisional Application is claimed for this application.

BACKGROUND OF THE INVENTION

1. Technical Field

This invention relates generally to loud speakers used in audio systems. More particularly, this invention relates to a speaker port with a contour that reduces boundary layer separation.

2. Related Art

There are many types of speaker enclosures. Each enclosure type can affect how sound is produced by the speaker. Typically, a driver is mounted flushed within the speaker enclosure. The driver usually has a vibrating diaphragm for emitting sound waves in front of a cone. As the diaphragm moves back and forth, rear waves are created behind the cone as well. Different enclosures types have different ways of handling these "rear" waves.

Many speakers take advantage of these rear waves to supplement forward sound waves produced by the cone. FIGS. 1 and 2 show a bass reflex enclosure that takes advantage of the rear waves. The enclosure has a small port. The backward motion of the diaphragm excites the resonance created by the spring of air inside the speaker enclosure and the mass contained within the port. The length and area of the port are generally sized to tune this resonant frequency. The port and speaker resonance is very efficient so the cone motion is reduced to near zero thereby greatly enhancing the bandwidth and the maximum output of the system that would otherwise be limited by the excursion of the cone.

In many speaker enclosures, sound waves passing through the port generate noise due to boundary layer separation. A sudden expansion or discontinuity in the cross-sectional area of the port can cause boundary layer separation of the sound waves from the port. Boundary layer separation occurs when there is excessive expansion along the longitudinal axis of the port. The fluid expansion causes excessive momentum loss near the wall or contour of the port such that the flow breaks off or separates from the wall of the port.

To minimize boundary layer separation, many port designs use flares in the shape of a nozzle at opposing ends of the port to provide smooth transitions. Often, different flares are tried until the "best" one is found. In many flare designs, the performance of the port may be poor because boundary layer separation will occur at the point along the longitudinal axis of the port where the adverse pressure gradient is largest. The pressure gradient or change in pressure may become great enough that the momentum of the sound wave or fluid is greater than the pressure holding the sound wave to the wall or contour. In this case, the sound wave separates from the wall, thus generating noise and losses. The point where the maximum pressure gradient occurs along the port limits the flow velocity from the port before separation occurs. Once the sound wave or flow separates from the port contour or wall at the point of maximum pressure gradient, flow losses increase dramatically and result in poor performance of the port.

SUMMARY

This invention provides a speaker port having a substantially constant pressure gradient that reduces or minimizes boundary layer separation. With a substantially constant pressure gradient, there essentially is no point in the speaker port where a higher pressure gradient occurs to limit the velocity of the sound waves.

The speaker port comprises a flare having a substantially constant pressure gradient. In a method to reduce boundary layer separation in a speaker port, the inner wall of a flare is configured to have a substantially constant pressure gradient.

Other systems, methods, features and advantages of the invention will be, or will become, apparent to one with skill in the art upon examination of the following figures and detailed description. It is intended that all such additional systems, methods, features and advantages be included within this description, be within the scope of the invention, and be protected by the following claims.

BRIEF DESCRIPTION OF THE DRAWINGS

The invention can be better understood with reference to the following figures. The components in the figures are not necessarily to scale, emphasis instead being placed upon illustrating the principals of the invention. Moreover, in the figures, like reference numerals designate corresponding parts throughout the different views.

DESCRIPTION OF THE PREFERRED EMBODIMENTS

Figure 1:
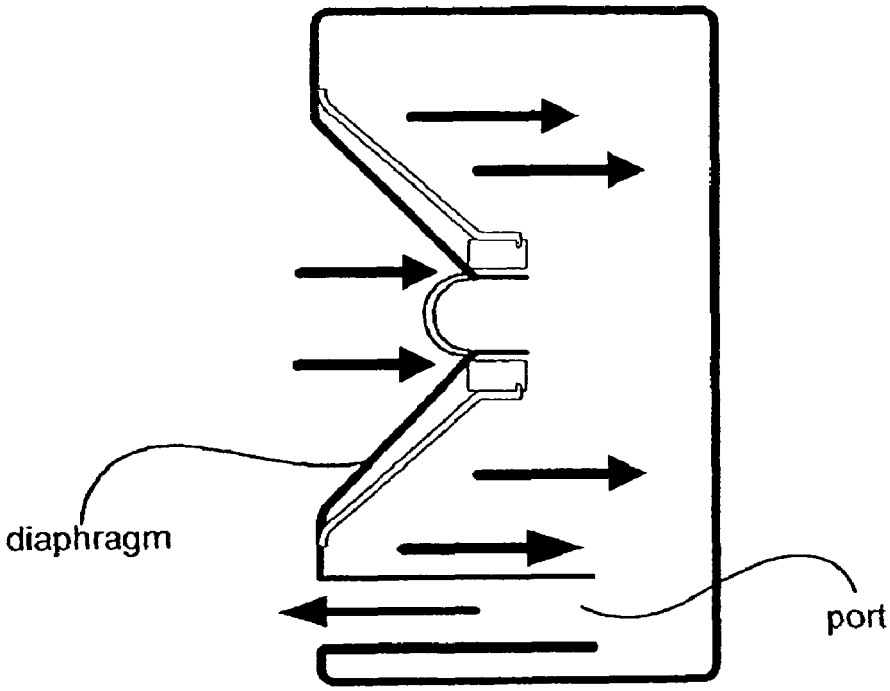
FIG. 1 (PRIOR ART)
FIG. 1 is a prior art cross-sectional view of a speaker enclosure with a transducer diaphragm in a rear position relative to its freestanding position.
Figure 2:
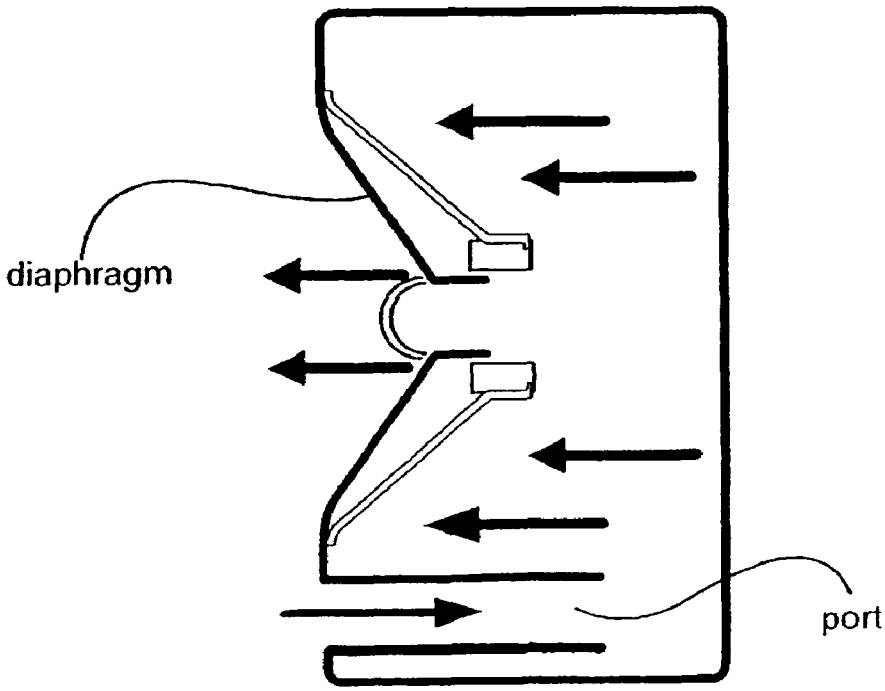
FIG. 2 (PRIOR ART)
FIG. 2 is a prior art cross-sectional view of the speaker with the diaphragm in a forward position relative to its freestanding position.
Figure 5:
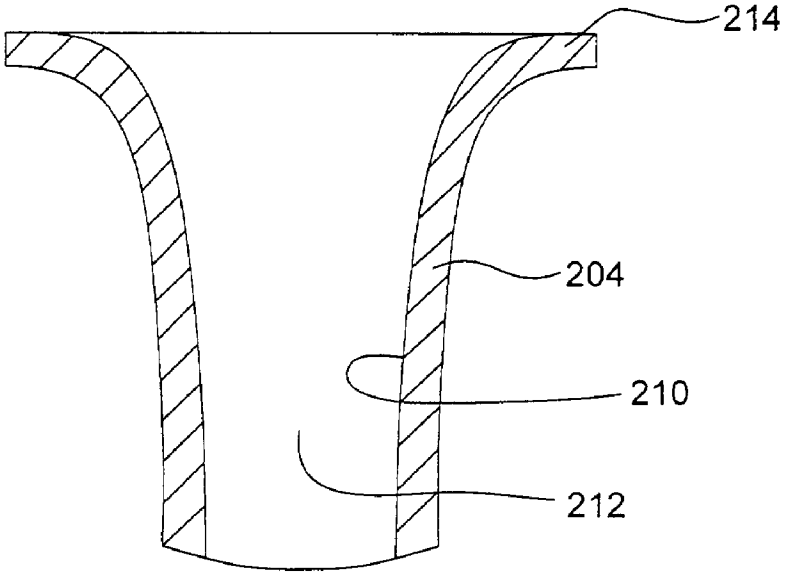
FIG. 5 is an enlarged cross-sectional view along Section B of the port shown in FIG. 4.
Figure 4:
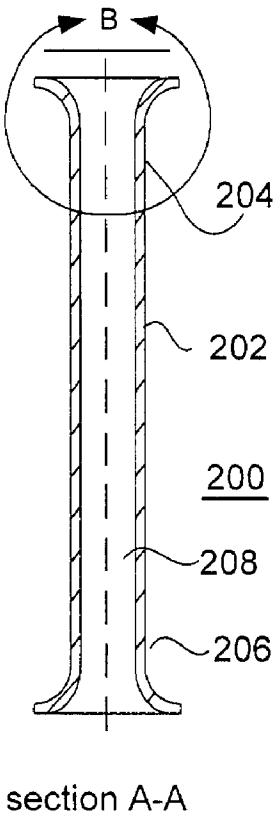
FIG. 4 is a cross-sectional view along Section A-A of the port shown in FIG. 3.
Figure 3:
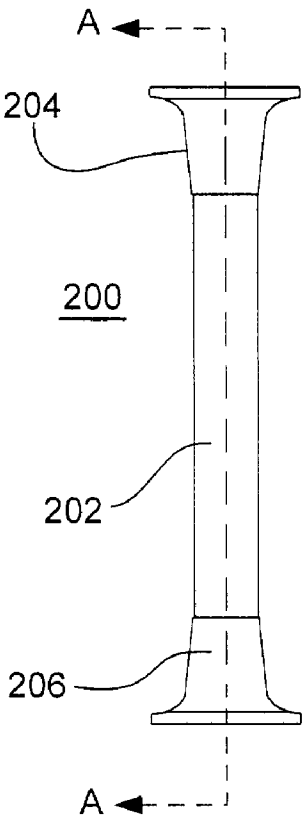
FIG. 3 is a side view of a port.

FIGS. 3-5 illustrate side and cross-sectional views of a loud speaker port 200. Port 200 has a cylinder 202 between two flares 204 and 206 that form a hollow core 208. Port 200 has an essentially circular cross-sectional area across the hollow core 208. Port 200 may have other cross-sectional areas across the hollow core 208 including an essentially elliptical cross-section. The port 200 may be non-circular and may be straight, bent, or have one or more curves. The port 200 may be symmetrical or non-symmetrical along a center axis. The port 200 may have other or a combination of configurations. The cylinder 202 and flare 204 and 206 may have the same or different configurations. The flares 204 and 206 are configured or shaped to provide a substantially constant pressure gradient for the sound wave or air flow through the port 200. The substantially constant pressure gradient reduces or minimizes boundary layer separation thus increasing or maximizing the air flow velocity through port 200. Each of the flares 204 and 206 has an inner wall or contour 210 between an inlet duct 212 and an outlet duct 214. The inner wall 210 is shaped or configured to provide substantially a constant pressure gradient over the entire length between the inlet and outlet ducts 212 and 214. While particular configurations are shown and discussed, port 200 may have other configurations including these with fewer or additional components.

The flares 204 and 206 each have an inner wall 210 that reduces or minimizes boundary layer separation so that fluids, such as air or sound waves, may flow through the flare at a higher velocity without boundary layer separation. The inner wall 210 is contoured so that the pressure gradient or change in pressure along the longitudinal axis of the flare from its inlet duct 212 to outlet duct 214 is substantially constant. The pressure gradient is substantially similar along the longitudinal axis of the flare. If the momentum or velocity of the fluid overcomes the pressure forces holding the flow to the wall, boundary layer separation can occur along the entire length of the flare. The performance of the flare improves because there is essentially no point along the longitudinal axis of the flare in which a higher pressure gradient occurs to limit velocity of the fluid. The point where a maximum or highest pressure gradient occurs has been changed so that performance is improved or optimized. With an essentially constant pressure gradient over the entire length of the flare, there is no peak or maximum pressure gradient at any point along the flare that limits the flow velocity of the fluid or sound wave.

In one aspect, the cylinder 202 is the interior portion of port 200 that has an essentially constant diameter. In this aspect, the flares 204 and 206 are the exterior portions of port 200 that have variable diameters. Generally, the cylinder 202 may be a separate or integral component of the flares 204 and 206. There may be no cylinder 202, when flare 204 transitions directly into flare 206. There may be only one flare or other multiples of flares. Flare 204 is essentially the same as flare 206. However, flare 204 may have different dimensions and/or a different configuration from flare 206.

Figure 6:
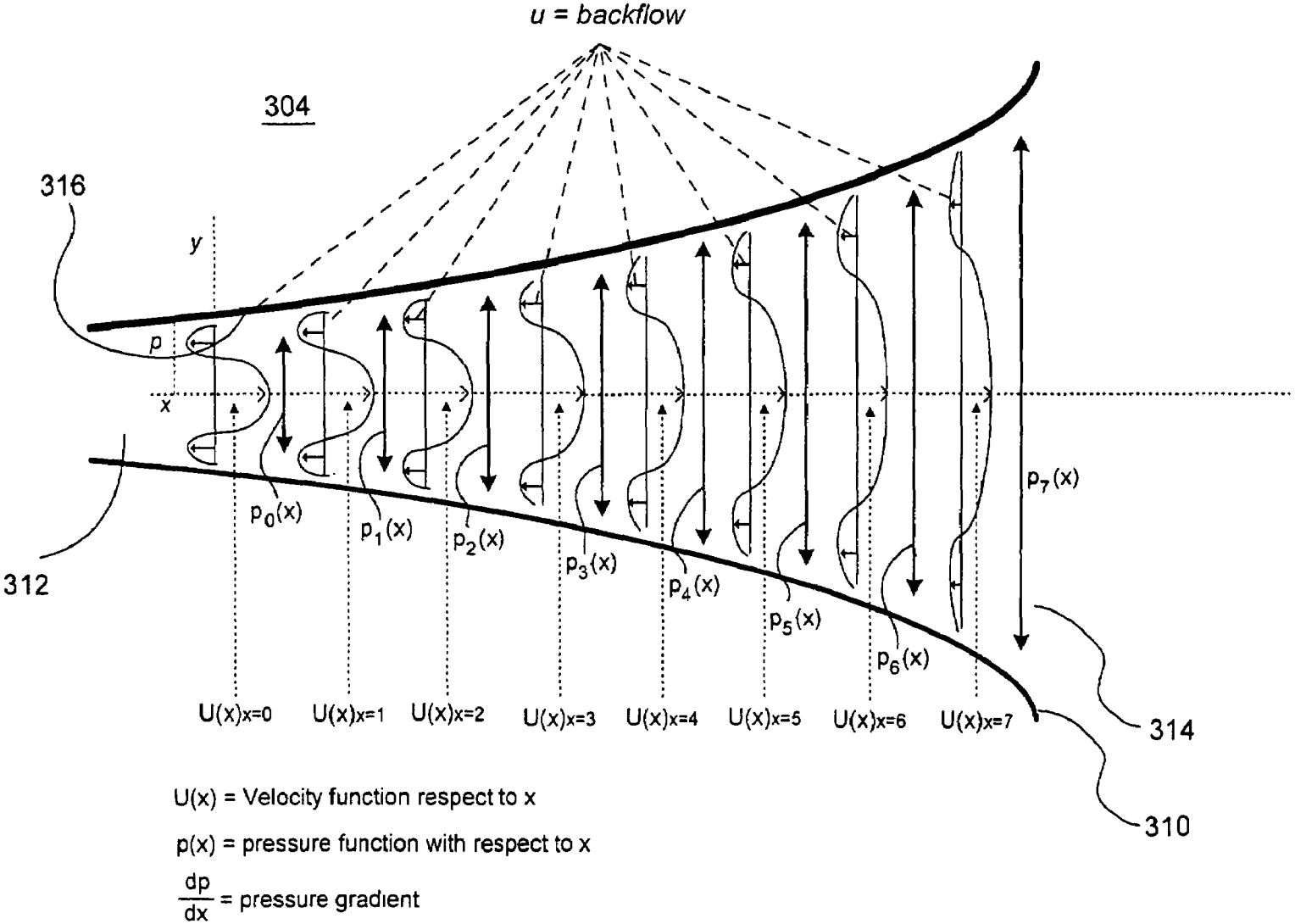
FIG. 6 is a cross-sectional view of a flare for a port in a speaker enclosure.

FIG. 6 represents a cross-sectional view of a flare 304 for a port in a speaker enclosure (not shown). The flare 304 provides substantially a constant pressure gradient over the entire length of the inner wall 310. The inner wall 310 is shaped or configured to achieve substantially a constant pressure gradient between inlet and outlet ducts 312 and 314. With a substantially constant pressure gradient, the flow velocity U(x) of fluid or sound waves passing through the flare at any given point along the x axis of the port is increased or maximized without boundary layer separation occurring. The pressure gradient is generally defined as dp/dx or simply, the change in pressure p over the change in distance x.

A substantially constant pressure gradient along the length of the flare 304 minimizes or reduces the adverse affect of the pressure gradient on any point and allows for a higher or maximum velocity of air flow to occur without boundary layer separation. A flare without a constant pressure gradient has one or more points from the inlet duct 312 to the outlet duct 314 with higher pressure gradients. Boundary layer separation can occur at high pressure gradient points along the flare with air velocities that are comparatively lower than if there was a constant pressure gradient.

The pressure at points along the length of the flare 304, $P_0(x)$ through $P_6(x)$, changes with respect the widening of the flare. If the change in pressure with respect to the change in distance is too high, an excessive adverse pressure gradient occurs. The pressure along the boundary of the walls 310 will not be enough to overcome the momentum of the sound wave or air flow U(x). An essentially constant pressure gradient allows a higher or maximum air flow velocity without flow separation because the constant pressure gradient causes the flow to expand uniformly along the points of the flare length as the sound wave or flow progresses through the flare 304.

The shape or contour of the inner wall 310 provides a substantially constant pressure gradient along the length of a circular flare and is defined or determined as follows:

$$\frac{dp}{dx} = \text{constant}$$ The pressure gradient $dp/dx$, is a constant. (1)

$$\frac{dp}{dx} = -\rho U(x)\frac{d(U(x))}{dx}$$ The Prantdl/Bernoulli Momentum-Integral relationship relates the pressure gradient to the velocity $U(x)\left(\frac{\text{in}}{\text{sec}}\right)$ and fluid density $\rho\left(\frac{\text{lb}}{\text{in}^3}\right)$. (2)

$$\frac{dp}{dx} + \rho U(x)\frac{d(U(x))}{dx} = 0$$ Rearrange. (3)

$$\frac{d(p+\rho U(x))}{dx} = 0$$ Simplify. (4)

$$p + \frac{\rho U(x)^2}{2} = c$$ Integrate. (5)

$$p = c - \frac{\rho U(x)^2}{2}$$ Rearrange. (6)

$$p = c - \frac{\rho A_{in}^2 U_{in}^2}{2A(x)^2}$$ Substitute $U(x) = \frac{A_{in}U_{in}}{A(x)}$, where $A_{in}$ is the initial area ($\pi r^2$) at the port opening or inlet duct 312 and $U_{in}$ is the initial velocity at the flare beginning or inlet duct 312. (7)

$$\frac{dp}{dx} = 0 - \frac{\rho A_{in}^2 U_{in}^2}{2}\frac{d\left(\frac{1}{A(x)^2}\right)}{dx}$$ Differentiate. (8)

$$\frac{dp}{dx} = 0 - \frac{\rho A_{in}^2 U_{in}^2}{2\pi^2}\frac{d\left(\frac{1}{y^4}\right)}{dx}$$ Substitute $A(x) = \pi y^2$. (9)

$$\frac{d\left(\frac{1}{y^4}\right)}{dx} = \frac{2\pi^2\Delta}{-\rho A_{in}^2 U_{in}^2}$$ Substitute $\frac{dp}{dx} = \Delta$ for convenience. (10)

$$\int\left[\frac{d\left(\frac{1}{y^4}\right)}{dx}\right] = \int\left[\frac{2\pi^2\Delta}{-\rho A_{in}^2 U_{in}^2}\right]$$ Integrate. (11)

$$\rightarrow \frac{1}{y^4} = \frac{2\pi^2\Delta}{-\rho A_{in}^2 U_{in}^2}x + c$$ Integration result.

$$y^4 = \frac{\rho A_{in}^2 U_{in}^2}{c\rho A_{in}^2 U_{in}^2 - 2\pi^2\Delta x}$$ Rearrange. (13)

$$y(x) = \sqrt[4]{\frac{-\rho A_{in}^2 U_{in}^2}{c\rho A_{in}^2 U_{in}^2 - 2\pi^2\Delta x}}$$ Final Equation. (14)

The contour of a flare is calculated using Equation (14) with an initial velocity $U_{in}$, an initial flare area $A_{in}$ that specifies the initial radius $r_{in}$ such as $A_{in}=\pi r_{in}^2$, a desired pressure gradient $\Delta=dp/dx$, the fluid density ρ, and the integration constant c. Equation 14 may vary depending upon the initial cross-section area and other cross-sectional areas of the flare, especially when the flare is non-circular.

Figure 7:
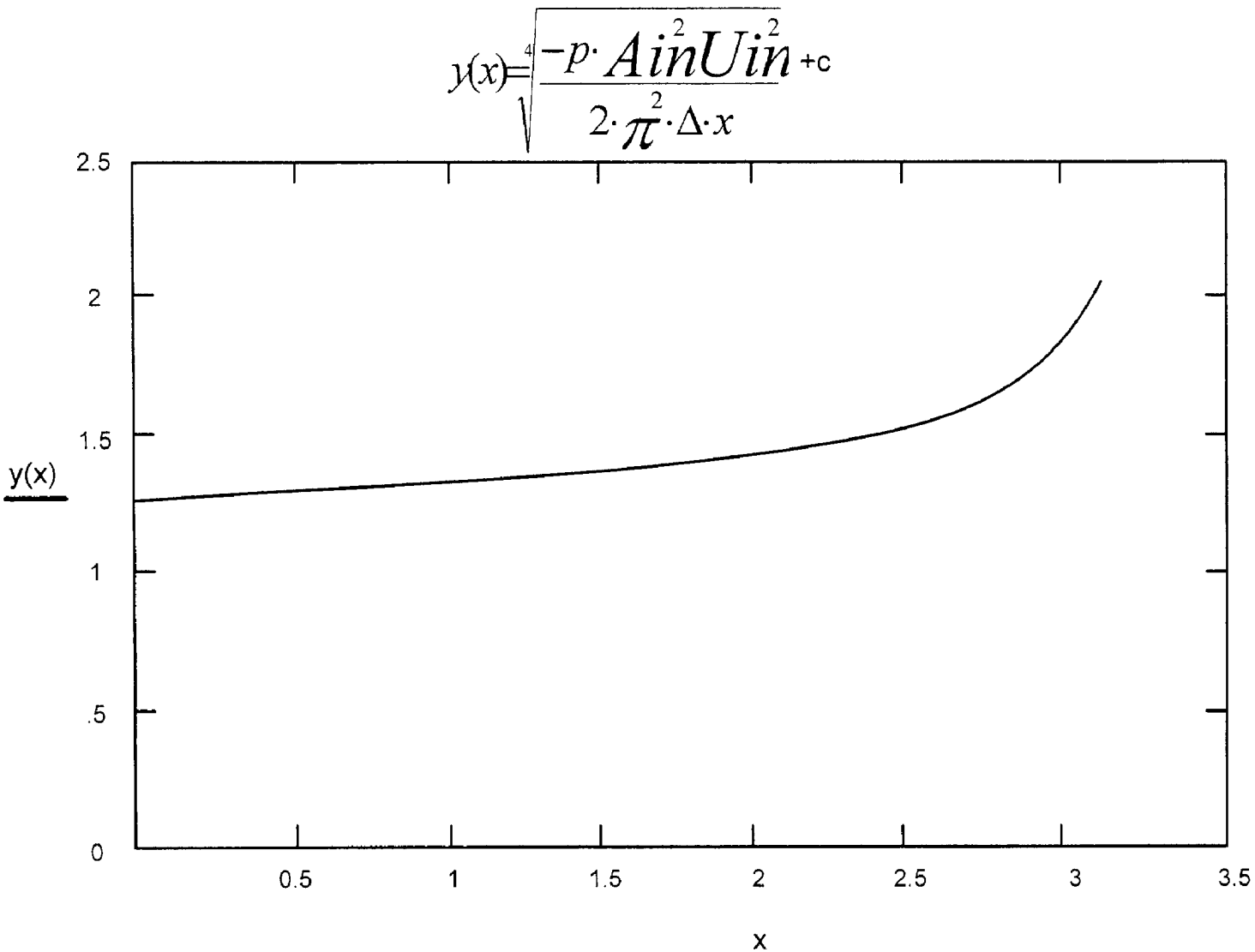
FIG. 7 is a graph illustrating a configuration for a flare.

FIG. 7 is a graph illustrating the plot of a contour specifying the radius y in inches for a given position x in inches along the length of a flare. The pressure gradient remains constant at 240. The integration constant $c_{initial}$ is 1.375. The initial radius is 1.375 in. The fluid density is 0.0000466 lb/in$^3$. These particular values and the related graph in FIG. 4 are for illustration purposes. Other values, graphs, and contours may be used. Any mathematical plot may be used to determine the contour of a port so long as the pressure gradient dp/dx remains substantially constant.

In another aspect, the shape or contour of the inner wall 310 provides a substantially constant pressure gradient along the length of a circular flare and is defined or determined as follows:

| | | |
|---|---|---|
| $\frac{dp}{dx} = \text{constant} = \Delta$ | The pressure gradient $dp/dx$ is a constant $\Delta$. | (15) |
| $\frac{dp}{dx} = -\rho U(x) d(U(x))$ | The Prantdl/Bernoulli Momentum-Integral relationship relates the pressure gradient is to the velocity $U(x)\left(\frac{\text{in}}{\text{sec}}\right)$ and fluid density $\rho\left(\frac{\text{lb}}{\text{in}^3}\right)$. | (16) |
| $\Delta \int dx = -\rho \int U(x) d(U(x))$ | Integrate. | (17) |
| $\rightarrow \Delta x = -\rho \frac{U^2(x)}{2} + c$ | Integration result. | |
| $\Delta x = -\rho \frac{A_{in}^2 U_{in}^2}{2A^2(x)} + c$ | Substitute $U(x) = \frac{A_{in} U_{in}}{A(x)}$, where $A_{in}$ is the initial area ($\pi r^2$) at the port opening or inlet duct 312 and $U_{in}$ is the initial velocity at the flare beginning or inlet duct 312. | (18) |
| $p = \Delta - \frac{\rho A_{in}^2 U_{in}^2}{2\pi^2 y^4} + c$ | Substitute $A(x) = \pi y^2$ and solve for $y$. | (19) |
| $y(x): \sqrt[4]{\frac{-\rho A_{in}^2 U_{in}^2}{2\pi^2 \Delta x + c}}$ where $c = -\frac{\rho A_{in}^2 U_{in}^2}{2\pi 2 r_{in}^4}$ $Y(0) = r_{in}$. | Final Equation. | (20) |

The contour of a flare is calculated using Equation (20) with an initial velocity $U_{in}$, an initial flare area $A_{in}$ (which specifies the initial radius $r_{in}$ such as $A_{in}=\pi r_{in}^2$), a desired pressure gradient $\Delta$=dp/dx, and the fluid density $\rho$. Equation 20 may vary depending upon the initial cross-section area and other cross-section areas of the flare, especially when the flare is non-circular.

With either Equations (14) or (20), the inner wall 310 of the flare 304 may be shaped or configured to provide a substantially similar pressure gradient over the length of the flare 304 between the inlet and outlet ducts 312 and 314. With either Equation, the length of flare 304 between the inlet and outlet ducts 312 and 314 may be used to increase the velocity of the fluid or sound wave through the flare 304 while avoiding boundary layer separation. The inner wall of the flare 304 is thus shaped so that the pressure gradient along the flare 304 is substantially similar or constant, thus minimizing or reducing boundary layer separation.

The same port performance can be achieved using non-circular sections, non-symmetrical sections, or a combination. Equations 14 and 20 are adjusted by substituting the appropriate area relationship for the configuration of the port. In addition, the port may not be rotationally symmetrical. One side could be flat while the other side is varied to maintain the desired area expansion.

Other pressure and/or fluid equations may be used to shape or configure the inner wall to provide a substantially constant pressure gradient. Various computer programs may be used to perform the calculations of this invention including Matlab™ and Mathematica.™ These programs may be used to plot the contour of a flare while keeping the pressure gradient constant.

While various embodiments of the application have been described, it will be apparent to those of ordinary skill in the art that many more embodiments and implementations are possible within the scope of this invention. Accordingly, the invention is not to be restricted except in light of the attached claims and their equivalents.

What is claimed is:

1. A speaker port comprising a flare having a nonzero pressure gradient that is substantially constant along at least a portion of an axial length of the flare during operation of the speaker port, where at least a portion of the flare is defined, at least in part, based on a Prandt/Bernoulli Momentum-Integral relationship that relates the pressure gradient $$\frac{dp}{dx}$$

to velocity U(x) and fluid density $\rho$ according to the following equation:

$$\frac{dp}{dx} = -\rho U(x) \frac{d(U(x))}{dx}.$$

2. The speaker port according to claim 1 where the flare is non-circular.

3. The speaker port according to claim 1 where the flare is not symmetrical about an axis.

4. The speaker port of claim 1, where the flare further comprises an inner wall defined by the following equation, $$y(x) = \sqrt[4]{\frac{-\rho A_{in}^2 U_{in}^2}{2\Pi^2 \Delta X + c}}$$

where y is a radius of the flare for a given portion x on the inner wall, $\rho$ is fluid density, $A_{in}$ is initial flow area, $U_{in}$ is initial velocity, $\Delta$ is pressure gradient dp/dx, and c is a constant.

5. The speaker port according to claim 4, where $$c = -\frac{PA_{in}^2 U_{in}^2}{2\Pi 2 r_{in}^4}$$

where $r_{in}$ is an initial radius.

6. The speaker port according to claim 1, further comprising a second flare.

7. The speaker port according to claim 6, where the flares have essentially the same dimensions.

8. The speaker port according to claim 6, where the flares have essentially the same pressure gradient.

9. The speaker port according to claim 6, further comprising a cylinder connected between the flares, where the cylinder and flares form a hollow core.

10. The speaker port according to claim 9, where the hollow core has an essentially circular cross-section.

11. The speaker port according to claim 9 where the hollow core has an essentially elliptical cross-section.

12. The speaker port according to claim 1, where the flare further comprises an inner wall extending from an inlet duct to an outlet duct, and where the inner wall provides a substantially constant pressure gradient from the inlet duct to the outlet duct.

13. The speaker port according to claim 1, where the speaker port comprises a speaker enclosure.

14. The speaker port of claim 1, where the flare comprises an inner wall with dimensions selected in response to one or more of: a fluid density, a predetermined initial flow area for the flare, a predetermined initial velocity of a fluid medium in the flare, and a predetermined pressure gradient in the flare.

15. The speaker port of claim 1, where the flare comprises an inner wall with dimensions selected in response to factors including: a predetermined initial flow area for the flare and a predetermined initial velocity of a fluid medium in the flare.

16. The speaker port of claim 1, where the substantially constant nonzero pressure gradient comprises dp/dx, where ρ is a pressure along an inner wall of the flare of the speaker port, and where x is a distance along a direction between an inlet duct and an outlet duct of the speaker port.

17. The speaker port according to claim 16, where the substantially constant nonzero pressure gradient is substantially constant over an entire length of an inner wall of the speaker port.

18. A speaker port comprising:

at least one flare having an inner wall defined by the following equation, $$y(x) = \sqrt[4]{\frac{-\rho A_{in}^2 U_{in}^2}{2\Pi^2 \Delta X + c}}$$

where y is a radius of the at least one flare for a given position x on the inner wall, ρ is fluid density, $A_{in}$ is initial flow area, $U_{in}$ is initial velocity, Δ is an essentially constant pressure gradient dp/dx, and c is a constant.

19. The speaker port according to claim 18, where $$c = -\frac{PA_{in}^2 U_{in}^2}{2\Pi 2 r_{in}^4}$$

where $r_{in}$ is an initial radius.

20. The speaker port according to claim 18, when the flare is non-circular.

21. The speaker port according to claim 18, where the flare is not symmetrical about an axis.

22. The speaker port according to claim 18, further comprising a cylinder connected to the at least one flare, where the cylinder and at least one flare form a hollow core.

23. The speaker port according to claim 22, where the hollow core has an essentially circular cross-section.

24. The speaker port according to claim 22, where the hollow core has an essentially elliptical cross-section.

25. The speaker port according to claim 18, where the speaker port comprises a speaker enclosure.

26. A method for reducing boundary layer separation in a speaker port, comprising configuring an inner wall of a flare to have a nonzero pressure gradient that is substantially constant along at least a portion of an axial length of the flare during operation for a sound wave of any frequency transmitted through the speaker port, at least a part of the inner wall defined, at least in part, based on a Prandt/Bernoulli Momentum-Integral relationship that relates the pressure gradient $$\frac{dp}{dx}$$

to velocity U(x) and fluid density ρ according to the following equation:

$$\frac{dp}{dx} = -\rho U(x)\frac{d(U(x))}{dx}.$$

27. The method of claim 26, further comprising:

defining a contour of the inner wall by the following equation, $$y(x) = \sqrt[4]{-\frac{\rho A_{in}^2 U_{in}^2}{2\Pi \Delta x + c}}$$

where y is a radius of the flare for a given position x on the inner wall, ρ is fluid density, $A_{in}$ is initial flare area, $U_{in}$ is initial velocity, Δ is pressure gradient dp/dx, and c is a constant.

28. The method according to claim 27, where $$c = -\rho\frac{A_{in}^2 U_{in}^2}{2\Pi 2 r_{in}^4}$$

where $r_{in}$ is an initial radius.

29. An audio loudspeaker comprising:

an inlet;

an outlet;

a flared wall connecting the inlet and the outlet, where the flared wall is contoured so that during operation, for a sound wave of any frequency transmitted through the audio loudspeaker, a pressure gradient in the direction from the inlet to the outlet is substantially constant along at least a portion of the flared wall in a direction from the inlet to the outlet, and where at least a portion of the flared wall is defined, at least in part, based on a Prandt/Bernoulli Momentum-Integral relationship that relates the pressure gradient $$\frac{dp}{dx}$$

to velocity U(x) and fluid density ρ according to the following equation:

$$\frac{dp}{dx} = -\rho U(x)\frac{d(U(x))}{dx}.$$

30. The audio loudspeaker according to claim 29, where the flared wall has a non-circular lateral cross-section.

31. The audio loudspeaker of claim 29, where the hollow core has an essentially elliptical cross-section.

32. The audio loudspeaker according to claim 29, further comprising a speaker enclosure.

33. A speaker port comprising:

at least one flare with at least a portion of the flare substantially following the equation:

$$y(x) = \sqrt[4]{-\frac{\rho A_{in}^2 U_{in}^2}{2\Pi^2 \Delta x + c}}$$

where y is a radius of the at least one flare for a given position x on the inner wall, ρ is fluid density, $A_{in}$ is initial flow area, $U_{in}$ is initial velocity, Δ is an essentially constant pressure gradient dp/dx, and c is a constant.

34. The speaker port according to claim 33, where $$c = -\rho\frac{A_{in}^2 U_{in}^2}{2\Pi 2 r_{in}^4}$$

where $r_{in}$ is an initial radius.

35. The speaker port according to claim 33, where the flare is non-circular.

36. The speaker port according to claim 33, where the flare is circular.

37. The speaker port according to claim 33, where the flare is not symmetrical about an axis.

38. The speaker port according to claim 33, where the flare is symmetrical about an axis.

39. The speaker port according to claim 33, further comprising a cylinder connected to the at least one flare, where the cylinder and the at least one flare form a hollow core.

40. The speaker port according to claim 39, where the hollow core has an essentially circular cross-section.

41. The speaker port according to claim 39, where the hollow core has a non-circular cross-section.

42. The speaker port according to claim 39, where the hollow core has an essentially elliptical cross-section.

43. The speaker port according to claim 33, where the radius y(x) is expressed as:

$$y(x) = \sqrt{\frac{A(x)}{\pi}}$$

where A(x) is the area cross-section of the flare at any point x along any portion of the wall.

44. The speaker port according to claim 33, where the speaker port comprises a speaker enclosure.

45. The speaker port according to claim 33, where the wall is an inner wall.

46. The speaker port according to claim 33, where an entire portion of the flare substantially follows the equation:

$$y(x) = \sqrt[4]{-\frac{\rho A_{in}^2 U_{in}^2}{2\Pi^2 \Delta x + c}}$$

where y is a radius of the at least one flare for a given position x on the inner wall, ρ is fluid density, $A_{in}$ is initial flow area, $U_{in}$ is initial velocity, Δ is an essentially constant pressure gradient dp/dx, and c is a constant.

47. The speaker port according to claim 33, where the flare has a nonzero pressure gradient that is substantially constant along the portion of the flare during operation of the speaker port.

48. An audio loudspeaker comprising:

an inlet;

an outlet;

a flare connecting the inlet and the outlet, where at least a portion of the flare substantially follows:

$$y(x) : \sqrt[4]{\frac{-\rho A_{in}{}^2 U_{in}^2}{2\pi^2 \Delta x + c}}$$

where y is a radius of the at least one flare for a given position x on the inner wall, ρ is fluid density, $A_{in}$ is initial flow area, $U_{in}$ is initial velocity, Δ is an essentially constant pressure gradient dp/dx, and c is a constant.

49. The audio loudspeaker according to claim 48, where $$c = -\frac{PA_{in}{}^2 U_{in}^2}{2\,\Pi\, 2 r_{in}^4}$$

where $r_{in}$ is an initial radius.

50. The audio loudspeaker according to claim 48, where the flare is non-circular.

51. The audio loudspeaker according to claim 48, where the flare is circular.

52. The audio loudspeaker according to claim 48, where the flare is not symmetrical about an axis.

53. The audio loudspeaker according to claim 48, where the flare is symmetrical about an axis.

54. The audio loudspeaker according to claim 48, further comprising a cylinder connected to the at least one flare, where the cylinder and at least one flare form a hollow core.

55. The audio loudspeaker according to claim 54, where the hollow core has an essentially circular cross-section.

56. The audio loudspeaker according to claim 54, where the hollow core has a non-circular cross-section.

57. The audio loudspeaker according to claim 48, where the radius y(x) is expressed as:

$$y(x) = \sqrt{\frac{A(x)}{\pi}}$$

where A(x) is the area cross-section of the flare at any point x along any portion of the wall.

58. The audio loudspeaker according to claim 54, where the hollow core has an essentially elliptical cross-section.

59. The audio loudspeaker according to claim 48, where the speaker port comprises a speaker enclosure.

60. The audio loudspeaker according to claim 48, where the wall is an inner wall.

61. The audio loudspeaker according to claim 48, where an entire portion of the flare substantially follows the equation:

$$y(x) : \sqrt[4]{\frac{-\rho A_{in}{}^2 U_{in}^2}{2\pi^2 \Delta x + c}}$$

where y is a radius of the at least one flare for a given position x on the inner wall, ρ is fluid density, $A_{in}$ is initial flow area, $U_{in}$ is initial velocity, Δ is an essentially constant pressure gradient dp/dx, and c is a constant.

62. The audio loudspeaker according to claim 48, where the flare has a nonzero pressure gradient that is substantially constant along the portion of the flare during operation of the speaker port.

* * * * *

UNITED STATES PATENT AND TRADEMARK OFFICE

CERTIFICATE OF CORRECTION

PATENT NO. : 7,711,134 B2
APPLICATION NO. : 10/178400
DATED : May 4, 2010
INVENTOR(S) : Stead et al.

It is certified that error appears in the above-identified patent and that said Letters Patent is hereby corrected as shown below:

In the drawings, sheet 4, Fig. 7, the equation at the top of the graph should be: $y(x) = \sqrt[4]{\frac{-\rho A_{in}^2 U_{in}^2}{2\pi^2 \Delta x + c}}$ At column 6, in claim 4, the equation should be: $y(x) = \sqrt[4]{\frac{-\rho A_{in}^2 U_{in}^2}{2\pi^2 \Delta x + c}}$ At column 7, lines 40-41, claim 16, "...where ρ is a pressure along an inner wall..." should be changed to "...where p is a pressure along an inner wall..."

At column 7, in claim 18, the equation should be: $y(x) = \sqrt[4]{\frac{-\rho A_{in}^2 U_{in}^2}{2\pi^2 \Delta x + c}}$ At column 8, in claim 27, the equation should be: $y(x) = \sqrt[4]{\frac{-\rho A_{in}^2 U_{in}^2}{2\pi^2 \Delta x + c}}$ At column 9, in claim 33, the equation should be: $y(x) = \sqrt[4]{\frac{-\rho A_{in}^2 U_{in}^2}{2\pi^2 \Delta x + c}}$ At column 10, in claim 46, the equation should be: $y(x) = \sqrt[4]{\frac{-\rho A_{in}^2 U_{in}^2}{2\pi^2 \Delta x + c}}$ At column 10, in claim 48, the equation should be: $y(x) = \sqrt[4]{\frac{-\rho A_{in}^2 U_{in}^2}{2\pi^2 \Delta x + c}}$ At column 12, in claim 61, the equation should be: $y(x) = \sqrt[4]{\frac{-\rho A_{in}^2 U_{in}^2}{2\pi^2 \Delta x + c}}$ Signed and Sealed this Thirtieth Day of November, 2010

David J. Kappos

David J. Kappos
*Director of the United States Patent and Trademark Office*

UNITED STATES PATENT AND TRADEMARK OFFICE

CERTIFICATE OF CORRECTION

PATENT NO. : 7,711,134 B2
APPLICATION NO. : 10/178400
DATED : May 4, 2010
INVENTOR(S) : Stead et al.

It is certified that error appears in the above-identified patent and that said Letters Patent is hereby corrected as shown below:

At column 7, in claim 5, the equation should be: $c = -\frac{\rho A_{in}^2 U_{in}^2}{2\pi 2 r_{in}^2}$ At column 7, in claim 19, the equation should be: $c = -\frac{\rho A_{in}^2 U_{in}^2}{2\pi 2 r_{in}^2}$ At column 8, in claim 28, the equation should be: $c = -\frac{\rho A_{in}^2 U_{in}^2}{2\pi 2 r_{in}^2}$ At column 9, in claim 34, the equation should be: $c = -\frac{\rho A_{in}^2 U_{in}^2}{2\pi 2 r_{in}^2}$ At column 10, in claim 49, the equation should be: $c = -\frac{\rho A_{in}^2 U_{in}^2}{2\pi 2 r_{in}^2}$ Signed and Sealed this
Twenty-eighth Day of December, 2010

David J. Kappos

David J. Kappos
*Director of the United States Patent and Trademark Office*

UNITED STATES PATENT AND TRADEMARK OFFICE

CERTIFICATE OF CORRECTION

PATENT NO. : 7,711,134 B2
APPLICATION NO. : 10/178400
DATED : May 4, 2010
INVENTOR(S) : Stead et al.

It is certified that error appears in the above-identified patent and that said Letters Patent is hereby corrected as shown below:

At column 7, in claim 5, the equation should be: $$c = -\frac{\rho A_{in}^2 U_{in}^2}{2\pi 2 r_{in}^4}$$

At column 7, in claim 19, the equation should be: $$c = -\frac{\rho A_{in}^2 U_{in}^2}{2\pi 2 r_{in}^4}$$

At column 8, in claim 28, the equation should be: $$c = -\frac{\rho A_{in}^2 U_{in}^2}{2\pi 2 r_{in}^4}$$

At column 9, in claim 34, the equation should be: $$c = -\frac{\rho A_{in}^2 U_{in}^2}{2\pi 2 r_{in}^4}$$

At column 10, in claim 49, the equation should be: $$c = -\frac{\rho A_{in}^2 U_{in}^2}{2\pi 2 r_{in}^4}$$

This certificate supersedes the Certificate of Correction issued December 28, 2010.

Signed and Sealed this
Twenty-fifth Day of October, 2011

David J. Kappos

David J. Kappos
*Director of the United States Patent and Trademark Office*